US006443648B1

(12) United States Patent
Chao

(10) Patent No.: US 6,443,648 B1
(45) Date of Patent: Sep. 3, 2002

(54) BALLPOINT PEN WITH A BALL BEARING OF SHAPE MEMORY ALLOY

(76) Inventor: Chung Ping Chao, 4F, No. 3, Lane 206, Sec. 1, Ta-An Rd., Taipei (TW)

( * ) Notice: Subject to any disclaimer, the term of this patent is extended or adjusted under 35 U.S.C. 154(b) by 0 days.

(21) Appl. No.: 09/969,811

(22) Filed: Oct. 4, 2001

(51) Int. Cl.[7] ..... B43K 7/10
(52) U.S. Cl. ..... 401/215; 401/209
(58) Field of Search ..... 401/209, 208, 401/212, 215

(56) References Cited

U.S. PATENT DOCUMENTS 3,094,103 A * 6/1963 Trefzer ..... 401/215
3,503,692 A * 3/1970 Kubota et al. ..... 401/215
3,746,456 A * 7/1973 Hill ..... 401/215
4,150,905 A * 4/1979 Kaplan et al. ..... 401/215

OTHER PUBLICATIONS

Otsuka et al., "Pseudoelasticity and shape memory effects in alloys," International Metals Reviews, 1986, vol. 31, No. 3, pp. 93–114.

* cited by examiner

*Primary Examiner*—David J. Walczak
(74) *Attorney, Agent, or Firm*—Birch, Stewart, Kolasch & Birch, LLP.

(57) ABSTRACT

A ballpoint pen has an ink reservoir tube which stores ink, a point assembly disposed in the front of the ink reservoir tube, and a ball bearing held at the front end of the point assembly. The ball bearing is a shape memory alloy, preferably a TiNi intermetallic compound or a TiNi based alloy. The ball bearing solves the problem of ink failing to flow when the ballpoint pen is dropped on the ground.

5 Claims, 4 Drawing Sheets

BALLPOINT PEN WITH A BALL BEARING OF SHAPE MEMORY ALLOY

BACKGROUND OF THE INVENTION

1. Field of the Invention

The present invention relates to a ballpoint pen, and more particularly, to a ballpoint pen with a ball bearing of a shape memory alloy (SMA).

2. Description of the Related Art

Ballpoint pens with oily, aqueous or intermediate inks are the most popular writing implements in the world. However, when a ballpoint pen is carelessly dropped, suffers impact at the point, or excessive force is applied, problems of ink leaking or failing to flow are likely to occur, despite ink remaining in the reservoir. An abraded or deformed ball bearing cannot successfully rotate at the pen point, limiting the space for flowing ink. Writing performance is compromised including uneven flow of ink, uncomfortable writing, increased flow of ink, or a failure to even write. Furthermore, in the fabrication of the ballpoint pen, the existence of deformation, stress and abrasion on the interior of the point assembly influences the writing performance.

Since the conventional ballpoint pen is easily deformed even with careful operation, it normally has a short lifetime, that is, the user needs to renew the point assembly or buy a new pen in a short time even when the reservoir is filled with ink. This is inconvenient and costly for users. In addition, with regard to environmental awareness, excessive ink remaining in the non-functional pen creates a resource waste and environmental pollution. Therefore, to increase the efficiency of the ballpoint pens, developments of a ball bearing able to overcome these problems is called for.

SUMMARY OF THE INVENTION

The present invention provides a ballpoint pen with a ball bearing of a shape memory alloy (SMA) to solve the problem of ink failing to flow when the ballpoint pen is dropped on the ground.

The ballpoint pen has an ink reservoir tube storing ink, a point assembly disposed at one end of the ink reservoir tube, and a ball bearing held at the front end of the point assembly. The ball bearing of a shape memory alloy, referred to a SMA ball bearing, is formed of materials selected from a TiNi intermetallic compound or a TiNi based alloy consisting of V, Cr, Mn, Fe, Co, Cu, Hf, Al, Pt, Si, Au, Pd and Zr.

Accordingly, it is a principal object of the invention to provide the SMA ball bearing with pseudoelasticity to prevent deformation from improper use or any other damaging conditions.

Another object of the invention is to increase the friction between the SMA ball bearing and the writing paper.

Yet another object of the invention is to assure the writing performance, such as comfortable writing sensation, normal flow of ink, and a long lifetime.

It is a further object of the invention to provide consistent, dependable ballpoint performance without renewing the point assembly or buying a new pen in a short time.

Still another object of the invention is to decrease the probability of discarding pens with remaining ink.

Another object of the invention is to solve the problems of resource waste and environmental pollution.

It is an object of the invention to achieve the purpose of preventing fatigue from compressive and tensile forces on the SMA ball bearing.

These and other objects of the present invention will become readily apparent upon further review of the following specification and drawings.

DETAILED DESCRIPTION OF THE PREFERRED EMBODIMENTS

Figure 1:
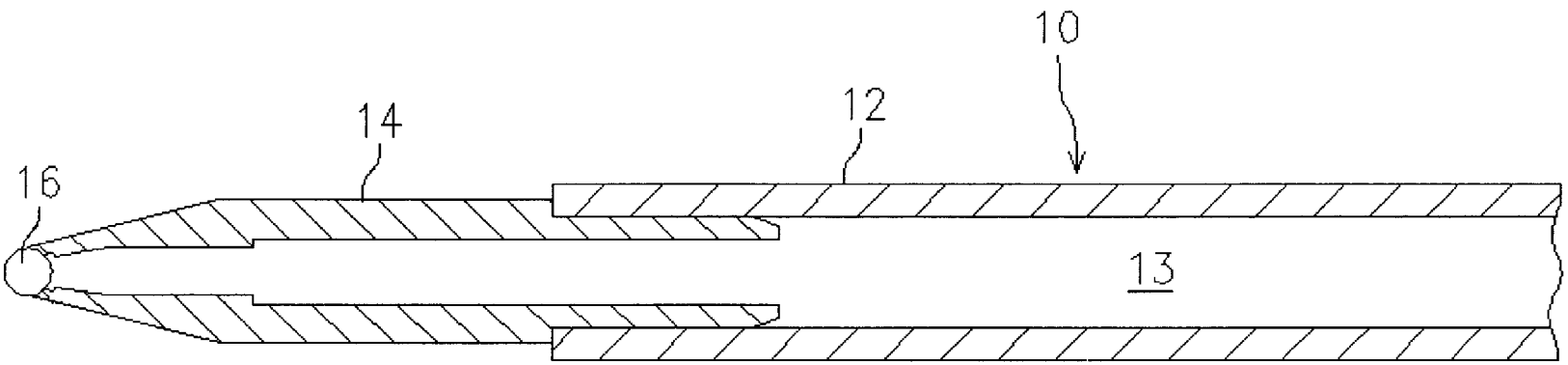
FIG. 1 is a schematic cross-section of a ballpoint pen according to the present invention.

FIG. 1 is a schematic cross-section of a ballpoint pen 10 according to the present invention. The present invention provides a ballpoint pen 10, which comprises an ink reservoir tube 12 storing ink 13, a point assembly 14 disposed at the front end of the ink reservoir tube 12, and at least a ball bearing 16 held at the front end of the point assembly 14. The ballpoint pen 10 can be designed as any workable shape i with obvious functioning elements. It is appreciated that fabrication of the ball bearing 16 and numbers of the ball bearing 16 are design choices dependent on the process employed. It is noticed that a shape memory alloy (SMA) is employed to form the ball bearing 16, referred as SMA ball bearing 16.

Figures 2A, 2B, 2C:
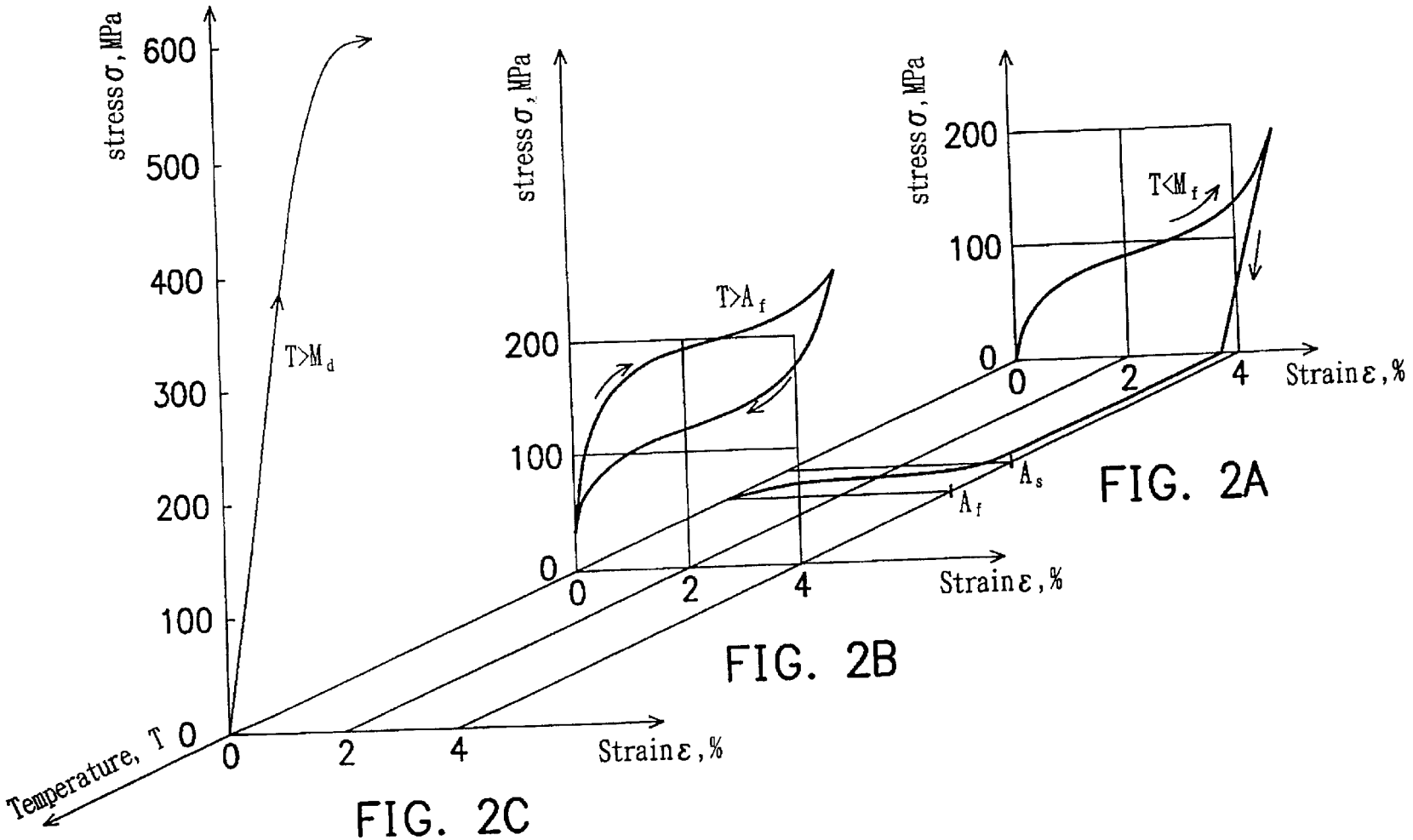
FIGS. 2A–2C show deformation behavior in a shape memory alloy as a function of stress, strain and temperature.

The mechanical properties of the shape memory alloy vary greatly over the temperature range spanning their transformation, typically including shape memory effect (SME), super-elastic effect (called pseudoelasticity), and high damping capacity. FIGS. 2A–2C show deformation behavior of a shape memory alloy as a function of stress, strain and temperature. The shape memory alloy can exist in two different temperature-dependent phases, called martensite (at lower temperature) and austenite (at higher temperature). When the martensite is heated, it begins to change into austenite, and the temperature at which this phenomenon starts is called $A_s$ (austenite start temperature). The temperature at which ;this phenomenon is complete is called $A_f$ (austenite finish temperature) When the austenite is cooled, it begins to change onto martensite, and the temperature at which this phenomenon starts is called $M_s$ (martensite start temperature). The temperature at which martensite is again completely reverted is called $M_f$ (martensite finish temperature).

Referring to FIG. 2A, when the SMA is in its martensite form, it is easily deformable. Thus, after removing the loading stress from the martensitic SMA, the deformation remains in the martensitic SMA. However, when the martensitic SMA is then heated to $A_f$ to become its austenite form, the remaining deformation is reverted to the unstrained shape, that is, recovering the original shape of the martensitic SMA. This is called the shape memory effect (SME).

Referring to FIG. 2B when the martensitic SMA is heated above $A_f$, outer stress can cause a martensite deformation, called a stress-induced martensite deformation, and then immediately exhibits the increasing strain. While, when the outer stress is released, the martensite transforms back into the austenite, and the SMA returns to its original shape based on the stress-induced martensite deformation. Thus, the shape recovery occurs in the austenitic SMA, not upon the application of heat but upon a reduction of stress. This is called the super-elastic effect or pseudoelasticity.

However, the pseudoelasticity is only observed over a specific temperature area. Referring to FIG. 2C, when the austenitic SMA is tested above $M_d$ (the highest temperature at which the martensite can no longer be stress induced), the deformation behavior appears as ordinary materials by slipping.

Figure 3:
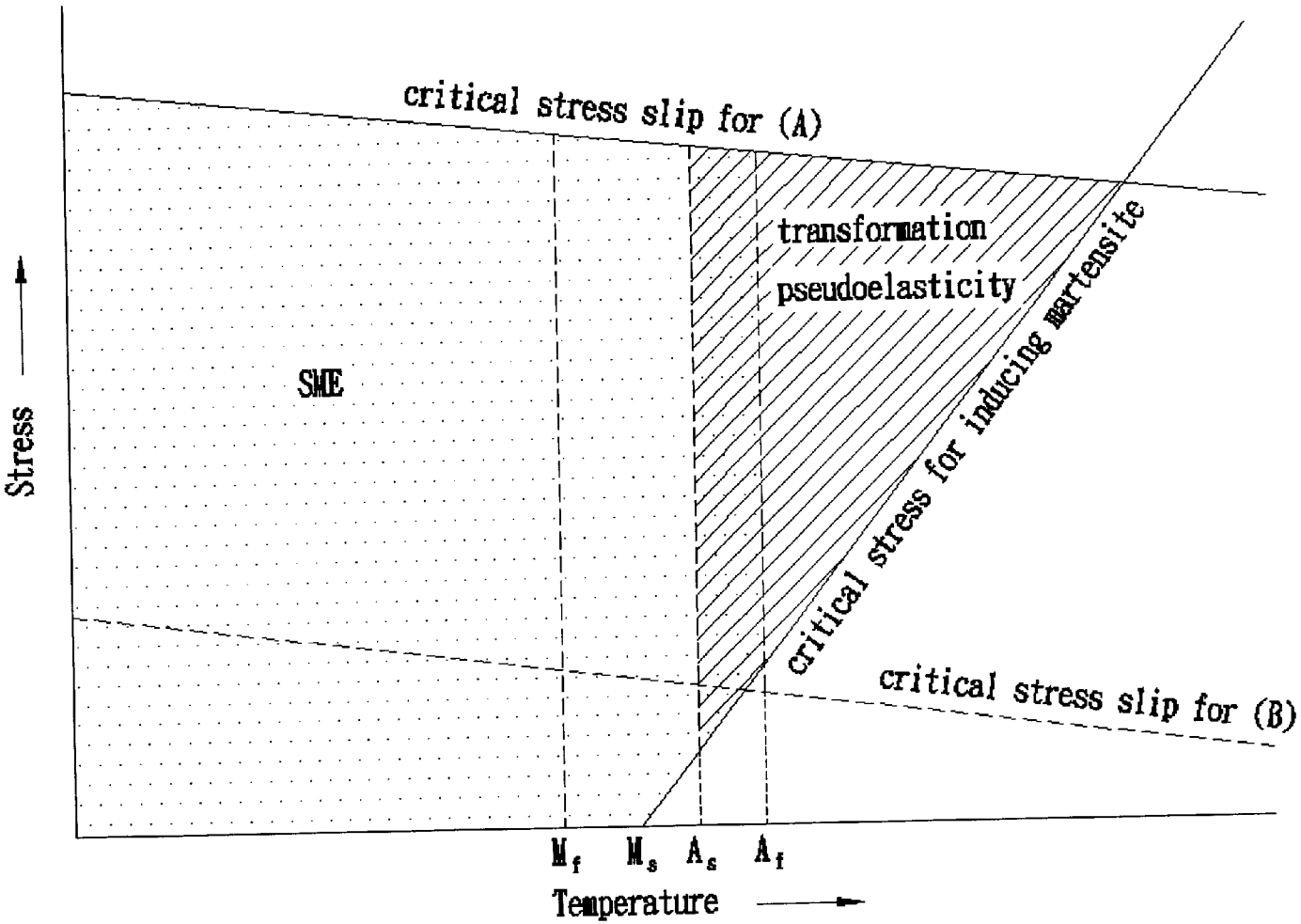
FIG. 3 is a schematic representation of the appearance of the pseudoelasticity.

FIG. 3 shows schematically the ranges of temperature and stress in which the shape memory effect (SME) and pseudoelasticity can occur, and their relation to the critical stress at which deformation begins by slippage. It is understood that if the critical stress slippage for the austenite is as high as (A), super-elastic deformation can occur in the stress-temperature area marked by the slanting lines. However, if the critical stress slip for the austenite is as low as (B), super-elastic deformation cannot occur at all. Therefore, the pseudoelasticity of the shape memory alloy is based on the stress induced martensitic transition in the austenitic SMA. When the stress is released, the martensite reverts to the austenite phase. That is, when the shape memory alloy is elastically deformed by application of stress, it recovers the original shape after removal of the stress.

Accordingly, the present invention employs the austenitic SMA with the pseudoelasticity to form the SMA ball bearing 16. When the SMA ball bearing 16 in its austenite phase is appropriately forced, it brings about a stress-induced martensite in the SMA ball bearing 16. Fortunately, the stress-induced martensite will recover to the original phase after removing the external force, and thereby the SMA ball bearing 16 recovers the original shape. It is believed that the elastic strain of the SMA ball bearing 16 greatly exceeds that placed on any traditional ballpoint pen in normal use.

The present invention provides a ballpoint pen 10 with SMA ball bearing 16 that can solve the prior art shortcomings. Owing to the pseudoelasticity, the SMA ball bearing 16 is not easily deformed when struck, dropped, used improperly, or suffers any other ill treatment. Compared with the steel ball bearing used in conventional ballpoint pens, the SMA ball bearing 16's softer nature increases the friction between paper and the SMA ball bearing 16. This assures comfortable writing performance and dependable ink flow so as to increase the lifetime of the ballpoint pen 10. In addition, users are assured of consistent, dependable ballpoint performance without renewing the point assembly or buying a new pen after a short time. Furthermore, the SMA ball bearing decreases the probability of users discarding pens with ink remaining, and thereby problems of resource waste and environmental pollution are reduced.

Figure 4:
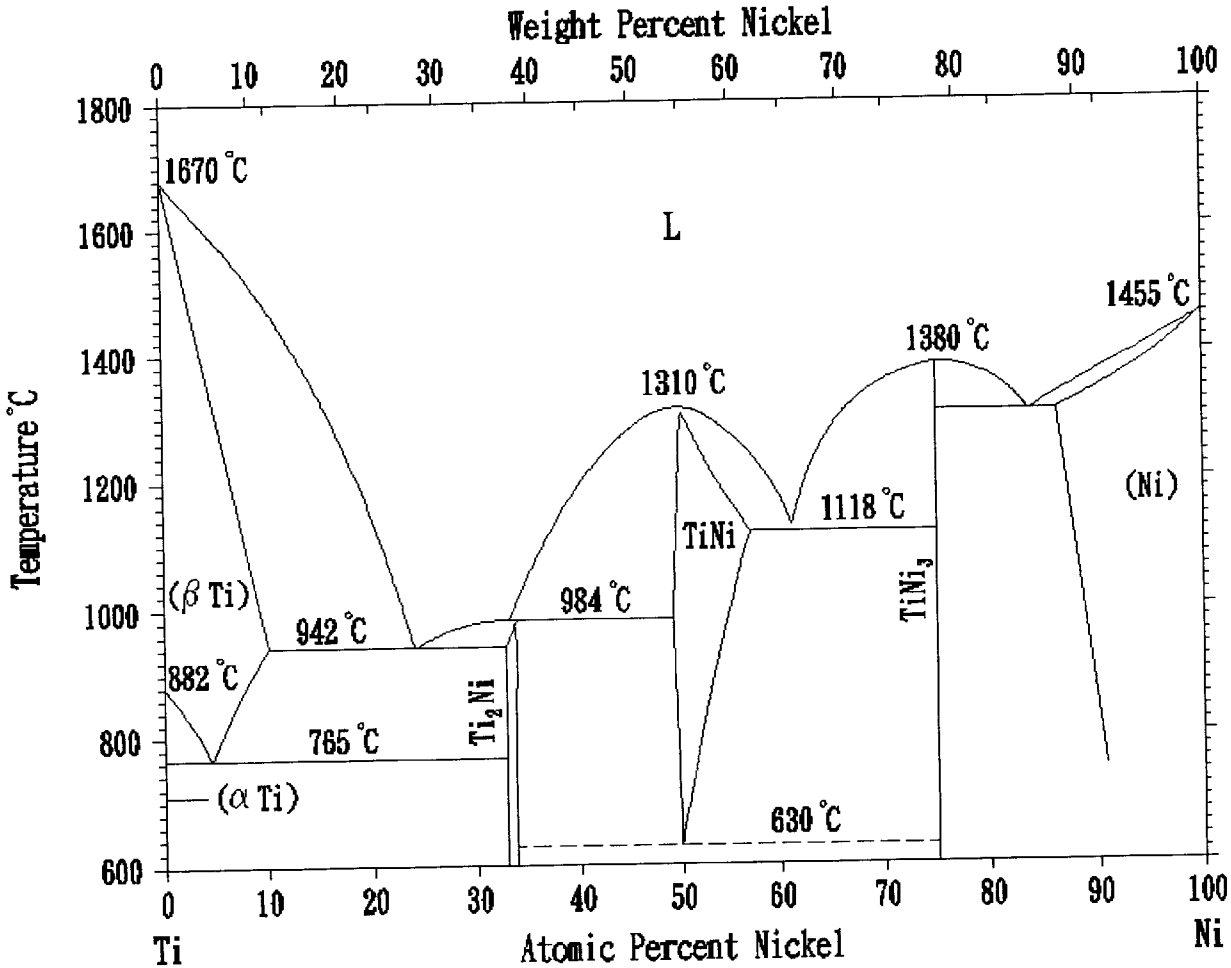
FIG. 4 is a Ti—Ni binary phase diagram. Similar reference characters denote corresponding features consistently throughout the attached drawings.

In the present invention, various alloys consisting of Ti and Ni having pseudoelasticity imparted thereto are used to form the SMA ball bearing 16. In one preferred embodiment, a TiNi intermetallic compound is used to form the SMA ball bearing 16, wherein the range of atomic percentage of the TiNi intermetallic compound is shown in FIG. 4 of a Ti—Ni binary phase diagram. In another preferred embodiment, a TiNi based alloy having pseudoelasticity is employed to form the SMA ball bearing 16, wherein the small addition of the TiNi based alloy is selected from at least one element of the group consisting of V, Cr, Mn, Fe, Co, Cu, Hf, Al, Pt, Si, Au, Pd and Zr.

It is to be understood that the present invention is not limited to the embodiments described above, but encompasses any and all embodiments within the scope of the following claims.

What is claimed is:

1. A ballpoint pen comprising:

an ink reservoir tube that stores ink;

a point assembly disposed in the front of the ink reservoir tube; and at least a ball bearing held at the front end of the point assembly, wherein the ball bearing is a shape memory alloy that is in austenite phase and has pseudoelasticity.

2. The ballpoint pen of claim 1, wherein the ball bearing of the shape memory alloy has shape memory properties.

3. The ballpoint pen of claim 1, wherein the ball bearing is a TiNi intermetallic compound.

4. The ballpoint pen of claim 1, wherein the ball bearing is a TiNi based alloy.

5. The ballpoint pen of claim 4, wherein the TiNi based alloy has at least one element selected from the group consisting of V, Cr, Mn, Fe, Co, Cu, Hf, Al, Pt, Si, Au, Pd and Zr.

* * * * *